United States Patent [19]

Wright

[11] 4,251,935

[45] Feb. 24, 1981

[54] PERPETUAL CALENDAR

[76] Inventor: Marvin A. Wright, 4507 Cole Ave., Dallas, Tex. 75205

[21] Appl. No.: 22,344

[22] Filed: Mar. 20, 1979

[51] Int. Cl.[3] ..... G09F 3/10

[52] U.S. Cl. ..... 40/109; 40/120; 283/2

[58] Field of Search ..... 40/109, 107, 110, 120; 283/2, 3

[56] References Cited

U.S. PATENT DOCUMENTS

| | | | |
|---|---|---|---|
| 786,618 | 4/1905 | Ball et al. | 40/109 |
| 1,286,058 | 11/1918 | Morris | 40/109 |
| 1,328,830 | 1/1920 | Friedman | 40/109 |
| 1,457,821 | 6/1923 | Cook | 40/109 |
| 1,687,950 | 10/1928 | Palmer | 40/109 |
| 2,335,713 | 11/1943 | Vogel | 40/109 |
| 2,434,860 | 1/1948 | Oxley | 40/10 D |

FOREIGN PATENT DOCUMENTS

| | | | |
|---|---|---|---|
| 2840013 | 4/1979 | Fed. Rep. of Germany | 40/109 |
| 439228 | 12/1935 | United Kingdom | 40/109 |

*Primary Examiner*—F. Barry Shay
*Assistant Examiner*—G. Lee Skillington
*Attorney, Agent, or Firm*—Clarence A. O'Brien; Harvey B. Jacobson

[57] ABSTRACT

A perpetual calendar in the form of a desk calendar or wall supporting calendar including a front panel with a window cutout revealing a laterally movable slide having a projecting tab thereon engageable with notches or seats to properly locate the slide in relation to the window and maintain the slide in position. The calendar also includes printed indicia above the window opening indicating the days of the week and printed indicia below the window opening indicating the years. The slide includes indicia indicating the date of the month and additional indicia indicating the month of the year thereby providing easily adjusted indicia which can be readily observed to provide a calendar which will properly indicate the day of the week, the month, the date of the month and the year for many years.

3 Claims, 3 Drawing Figures

PERPETUAL CALENDAR

BACKGROUND OF THE INVENTION

1. Field of the Invention

The present invention generally relates to a perpetual calendar which includes a movable calendar slide having indicia thereon designating the date of the month which is associated with a window opening in the front panel of a supporting structure with the calendar slide and supporting structure therefor including coacting tab and seats to enable the calendar slide to be easily adjusted and located in proper position for the particular month and year.

2. Disclosure Statement

Prior patents in this field disclose various types of known calendars having laterally movable calendar slides associated with a viewing window together with indicia to enable the calendar to be used for a number of years. The following U.S. Patents contain disclosures known to applicant:

| | | |
|---|---|---|
| 219,156 | Heath | Sept. 2, 1879 |
| 726,979 | O'Marra | May 5, 1903 |
| 1,353,751 | Hutson | Sept. 21, 1920 |
| 2,051,264 | Maddock | Aug. 18, 1936 |
| 2,246,633 | Lawlor | June 24, 1941 |
| Des. 140,313 | Ignall | Feb. 13, 1945 |

While such devices operate in the manner intended, it is difficult to properly locate and position the calendar slide in relation to the window opening and to maintain this position during normal use of the calendar.

SUMMARY OF THE INVENTION

It is an object of the present invention to provide a perpetual calendar having a front panel with a window opening therein and a laterally movable calendar slide disposed under the front panel with the calendar slide including date of the month indicia associated with day of the week indicia above the window opening so that the date of the month indicia can be properly located in relation to the day of the week indicia for the particular month and year to which the calendar is adjusted in which the calendar slide is provided with a projecting tab which can be easily grasped and moved along a slot with the guide slot including notches or seats in the lower edge thereof corresponding to the number of days in a week in order to enable the slide to be properly located and the tab received in the notch or seat to securely retain the calendar slide in adjusted position.

Another object of the invention is to provide a perpetual calendar which can be base supported on a desk or hung on the wall by a loop tab or the like.

A further object of the invention is to provide a perpetual calendar in accordance with the proceding objects which includes a front panel and a back panel with spacers along the side edges of the front and back panels to provide a space for receiving the slidable calendar slide and a horizontal support member between the front and back panels for supporting the calendar slide when in its adjusted position.

Still another object of the present invention is to provide a perpetual calendar in accordance with the preceding objects in which the front panel is also provided with indicia indicating the year for which the calendar is adjusted and the rear of the back panel is provided with indicia relating to holidays and other significant dates.

Yet another important object of the present invention is to provide a perpetual calendar which is easily adjusted for a particular month in a particular year and is relatively simple in construction and thus inexpensive but yet effective for the purposes of indicating the correct day of the week, date of the month and year date over a large number of years.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
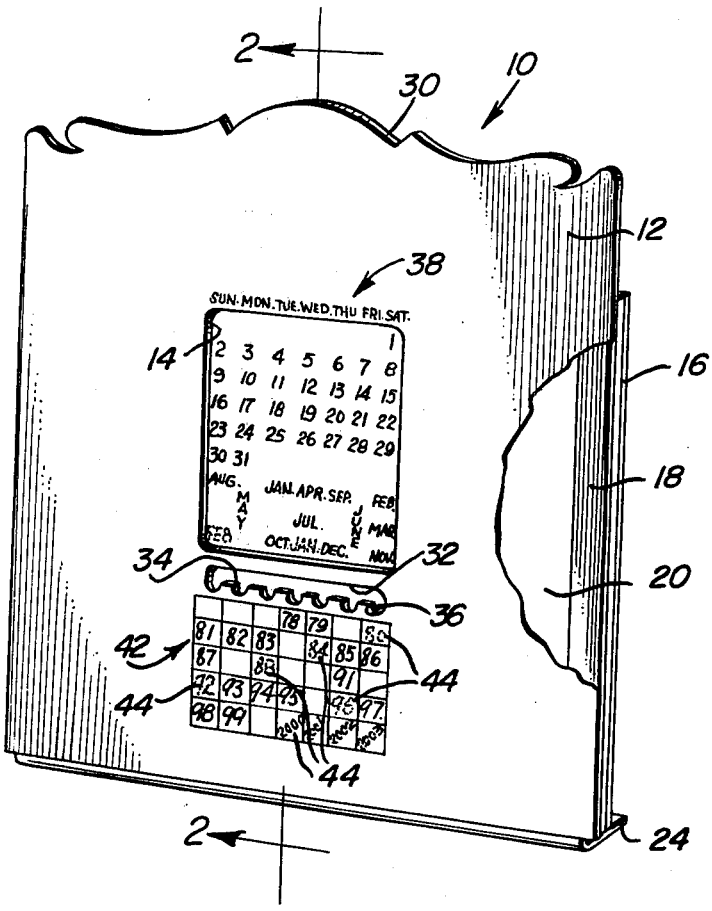
FIG. 1 is a perpspective view of the perpetual calendar of the present invention.
Figure 2:
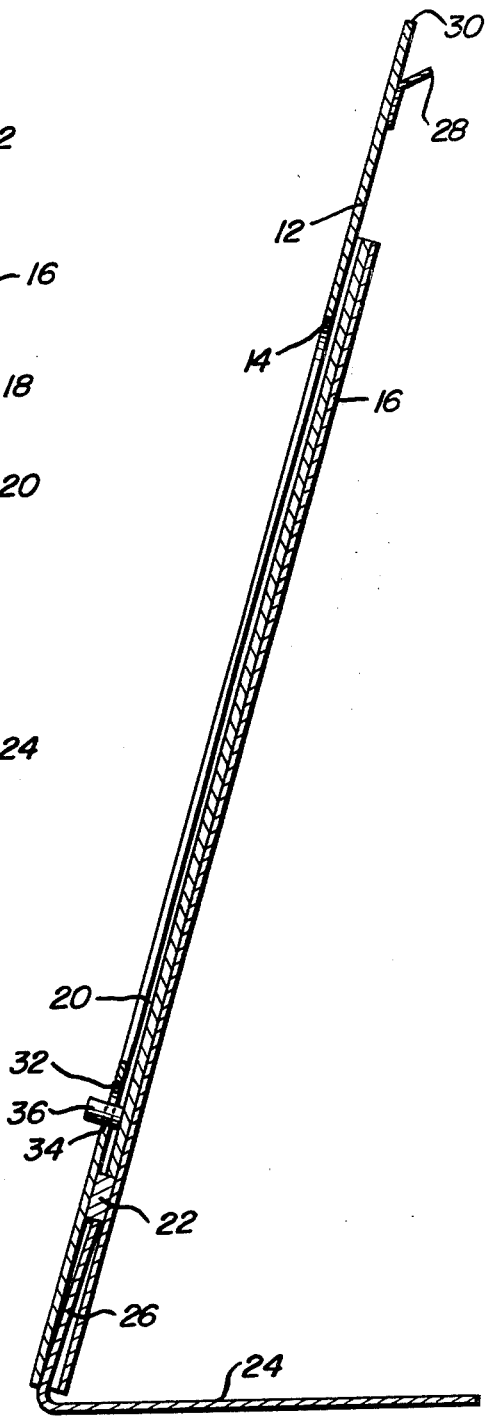
FIG. 2 is a vertical, sectional view, on an enlarged scale, taken substantially upon a plane passing along section line 2—2 of FIG. 1 illustrating the specific structural details of the components of the calendar.

The perpetual calendar of the present invention is generally designated by number 10 and includes a front panel 12 constructed of cardboard, plastic or other material and includes a front planar surface having a generally square window 14 cut therefrom or otherwise formed therein. A back panel 16 parallels the front panel 12 and is secured thereto in spaced relation by side spacers 18 which extend vertically between the front and back panels and are fixedly secured thereto such as by adhesive material or other fastening means thereby providing a space between the front and back panels in which a calendar slide 20 is received. The calendar slide is generally rectangular in configuratiion and has a lateral dimension substantially greater than the lateral dimension of the window 14 and a vertical dimension substantially greater than the vertical dimension of the window 14 with the structure of the calendar slide 20 being illustrated specifically in FIG. 3. Also interposed between the front panel and back panel is a horizontally disposed support 22 which supportingly engages the bottom edge of the calendar slide 20 as illustrated in FIG. 2. All of these components may be conveniently constructed of cardboard, stiff paper, plastic, wood, metal or other similar materials or combinations thereof.

The calendar 10 may be supported by a base 24 which extends horizontally and engages a supporting surface throughout the width of the calendar with the dimension of the base 24 being adequate to support the calendar on a desk or the like. One edge of the base 24 is provided with an upwardly extending flange 26 that is telescoped between the lower edge portions of the front panel 12 and back panel 16 and may either be frictionally retained therein or retained therein by adhesive material or other fastening devices. As illustrated, the upwardly extending flange 26 is at an acute angle to the base 24 thus supporting the calendar in an upwardly and rearwardly inclined relation as illustrated in FIG. 2. As an alternative support for the calendar, a loop tab 28 is attached to the center of the upper edge portion of the front panel 12 above the top edge of the back panel 16 as illustrated in FIG. 2. The loop tab 28 is secured to the front panel 12 by adhesive or other suitable fastening means and enables the calendar to be hung from a hook or other projection on a wall surface or the like with the base 24 being removed or omitted when the loop tab 28 is used to support the calendar.

The top edge of the front panel 12 may be provided with a scalloped or scroll design 30 or any other decorative arrangement and indicia relating to the name of the calendar, advertising or promotional material and the like may be provided on the front panel to facilitate the commercial use of the calendar. Also, the rear surface of the back panel 16 may be provided with indicia indicating legal holidays or other significant dates and information relating to the geographical area in which the calendar is intended to be used.

Figure 3:
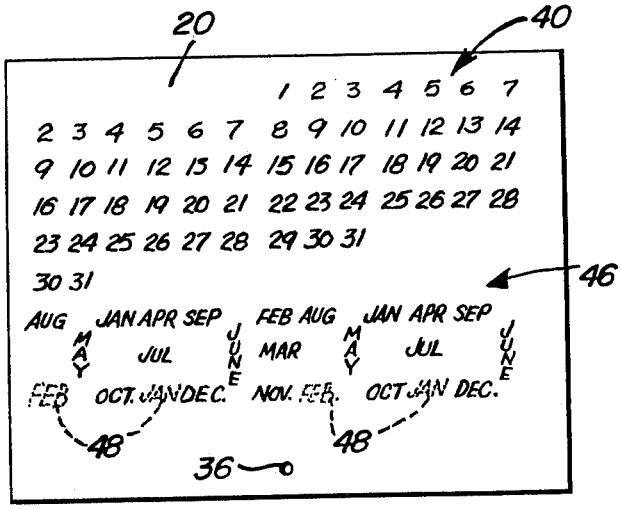
FIG. 3 is a plan view of the calendar slide illustrating the indicia thereon.

The front panel 12 is provided with a slot-like opening 32 therein which is in spaced parallel relation below the bottom edge of the window 14. The slot-like opening 32 includes a plurality of notches or seats 34 along the bottom edge thereof with the slot 32 and seats 34 receiving a forwardly projecting tab 36 affixed to the center bottom of the calendar slide 20 as illustrated in FIG. 3. Thus, by grasping the tab 36 which projects outwardly beyond the face of the front panel 12 and lifting the slide 20 slightly upwardly, the slide then can be moved laterally and the tab 36 placed into any one of the seats 34. The front panel 12 includes indicia 38 just above the top edge of the window 14 to indicate the days of the week with the days being either completely spelled out or abbreviated. Correspndingly, the tab seats 34 are aligned with the indicia indicating the days of the week with seven tab seats 34 being provided in alignment with the respective days of the week as indicated by the indicia 38 so that the tab 36 may be placed in a seat 34 to place the month over the desired year in a manner described hereinafter.

The calendar slide 20 includes numeral indicia 40 indicating the date of the month with the indicia being arranged in six horizontal columns with the top column commencing with the numeral 1 at the horizontal center of the slide and progressing to numeral 7 and the second column beginning with numeral 2 at the left-hand margin of the card and progressing to numeral 14 with the subsequent columns being similarly numbered so that the first day of the month may be set at any day of the week by manipulating the tab 36 in a obvious manner.

The front panel 12 is also provided with numerical indicia 42 indicating the calendar years by the last two digits of the year with those years indicating leap years including red numerals 44 on a white or light background or a black or distinguishably colored background while the other years are black numerals on a white or light background. The calendar slide 20 includes indicia 46 indicating the months of the year being duplicative under the vertical columns of numerical indicia 40 headed by numeral 2 and to the right thereof to the numeral columns headed by numeral 7. The vertical column headed by numeral 1 includes a column of month indicia as illustrated in FIG. 3 and certain of the months in the lower horizontal column of the indicia include red letters 48 on a white or light background or a black or dark background as illustrated in FIG. 3 which are used in leap years.

While the tab 36 and corresponding slot 32 and tab seats 34 have been illustrated in the front panel, it is also within the purview of the present invention for the tab 36 to project rearwardly through a corresponding slot and seat arrangement in the back panel thus leaving this area of the front panel 12 imperforate with the only opening in the front panel 12 being the window 14.

As illustrated, the calendar is a 25-year calendar through the year 2003. The month indication in the indicia 46 is placed over the desired year with the red letters for January and February being used for leap years which are indicated on the year indicia 42 by the same red letters on light background. The example illustrated in the drawings is for March or November 1980 in which the first day of the month is a Saturday. While the month of February is in the same column as March and November, since 1980 is a leap year, then the red lettered February to the right of the center column in the indicia 40 on the slide 20 is aligned with the year column indicating leap year 1980 so that the first day of February 1980 would be indicated as falling on a Friday. Those days at the end of the month in excess of 30 or in excess of 28 or 29 with respect to February may be disregarded.

The number of years for which the calendar is constructed may be varied and the particular formation of the indicia may also be varied, for example, various color distinguishable indicia may be employed and various backgrounds for the indicia may be employed depending upon preferences of individual manufacturers and users.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A perpetual calendar comprising a front panel having a window therein, a calendar slide supported behind the front panel in registry with the window, said slide including day of the month indicia thereon and month of the year indicia thereon located below the day of the month indicia, said indicia being observable through the window, said front panel including indicia above the window indicating the day of the week and indicia below the window indicating the year date, said slide including a tab adjacent the lower edge thereof to form a handle for moving the slide laterally of the front panel and window to align the month of the year with the year date thereby providing a calendar for that month of that year, said tab being aligned vertically with the first day of the month indicia, said front panel including a slot therein paralleling the bottom edge of the window and located adjacent thereto and above the year date indicia, said tab projecting through the slot, the bottom edge of the slot including a plurality of notches therein defining seats for the tab thereby locating and positioning the slide in adjusted position, the year indicating indicia being disposed in vertical columns, said month of the year indicia on the slide being arranged in vertical columns whereby the tab placed in one of the notches will be aligned with at least one year of the year indicia and the first day of the month will be properly aligned with the day of the week for the month or months indicated by the month of the year indicia which is located in vertical columns corresponding with the columns for the years, months of the years and day of the month columns.

2. The structure as defined in claim 1 wherein certain of the month of the year indicia and the year indicia are distinguishable in color to indicate January and February of leap years.

3. The structure as defined in claim 1 together with a back panel secured to the front panel in spaced relation thereto for capturing the slide therebetween, a support paralleling the bottom edge of the windows and disposed between the front panel and back panel for supporting the lower edge of the slide when the tab is received in one of the seats.

* * * * *